US011828578B2

(12) United States Patent
Knoth et al.

(10) Patent No.: US 11,828,578 B2
(45) Date of Patent: Nov. 28, 2023

(54) TACTICAL OBSCURANT DEVICE AND METHODS OF POWDER PACKING

(71) Applicant: BAE Systems Land & Armaments L.P., Arlington, VA (US)

(72) Inventors: Edward A. Knoth, Beavercreek, OH (US); Bhanumathi Chelluri, Dublin, OH (US); Karl W. Baker, Brookville, OH (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 704 days.

(21) Appl. No.: 16/947,981

(22) Filed: Aug. 26, 2020

(65) Prior Publication Data

US 2022/0065591 A1 Mar. 3, 2022

(51) Int. Cl.
*F41H 9/06* (2006.01)
*C06D 3/00* (2006.01)

(52) U.S. Cl.
CPC ..... *F41H 9/06* (2013.01); *C06D 3/00* (2013.01)

(58) Field of Classification Search
None
See application file for complete search history.

(56) References Cited

U.S. PATENT DOCUMENTS 11,286,214 B2 * 3/2022 Reimer ..... C06B 23/00
2018/0016202 A1 * 1/2018 Lombardi ..... C07D 307/33

* cited by examiner

*Primary Examiner* — Reginald S Tillman, Jr.
(74) *Attorney, Agent, or Firm* — Patterson Thuente IP

(57) ABSTRACT

A tactical obscurant device having an obscurant payload that comprises a plurality of powder particles radially pressed within a cavity of the obscurant device using a pulsed radial dynamic magnetic compaction process to provide a packing density of at least 40%, such that the obscurant payload has a greater packing density over traditional packing processes, which results in an increased obscurant cloud size upon detonation that is capable of screening in at least one range of the electromagnetic spectrum. The obscurant payload may be comprised of a single powder material, at least two layers of powder material, or may have a multi-layered packed structure using different types of powder materials that are packed concentrically for multispectral obscuration upon detonation. The pulsed radial dynamic compaction process not only allows for a greater packing density over traditional packing processes, but allows the plurality of powder particles to be disseminated as separate particles upon detonation for an increased cloud size for obscuration.

21 Claims, 8 Drawing Sheets

TACTICAL OBSCURANT DEVICE AND METHODS OF POWDER PACKING

TECHNICAL FIELD

The present invention is directed to a tactical obscurant device and methods of powder packing the tactical obscurant payload, more particularly an obscuration grenade and methods of packing the obscuration grenade with a high packing density of powder such that the obscuration grenade is capable of being aerosolized into an increased cloud upon detonation.

BACKGROUND

The Global War on Terror has seen an augmentation of the enemy from a strictly ground based village-to-village insurgency to large coordinated engagement with the use of armor and tactical vehicles. Many of today's weapons systems use surveillance and target acquisition, devices which can exploit the infrared and millimeter wavebands of the electromagnetic spectrum. Designing obscurant devices which can provide screening against such systems often results in complicated or costly solutions.

Obscurant devices are often used to protect a warfighter conducting their mission. Obscurant devices often employ compounds that are capable of blocking, scattering, and/or absorbing electromagnetic radiation to leverage military operations. Obscurants can aid with friendly operations by, for example, providing cover for troop movement, concealing the location and size of friendly forces, concealing valuable facilities from enemy forces, and marking targets. Obscurants can also obstruct and disrupt enemy operations by, for example, interfering with enemy communications and coordination. Obscurants provide these functions by forming a dense, obscurant cloud that lasts several seconds upon detonation.

Artificial obscurants may be selected to block electromagnetic radiation in various parts of the electromagnetic spectrum, including the visible spectrum (approximately 0.38 μm to approximately 0.78 μm), the near infrared spectrum (NIR) (approximately 0.78 μm to approximately 3 μm), the mid infrared spectrum (MIR) (approximately 3 μm to approximately 50 μm), the far infrared spectrum (FIR) (approximately 50 μm to approximately 1000 μm), or a combination thereof.

Traditional weapon delivery systems may be modified and used to deploy obscurants in the field. The explosive pay load of various munitions, including grenades, rockets, and other artillery, are removed and replaced with a payload comprising an obscurant composition. The use of a particular munition type depends on the particular use. For example, obscurant grenades may be employed in small-scale tactical combat operations. Rockets, mortars, smokepots or large-scale artillery carrying obscurant composition payloads may be used to conceal or protect large areas, such as air fields or large scale troop movements. Upon ignition or detonation, the obscurant composition burns to produce a cloud of smoke that blocks a given spectrum of electromagnetic radiation.

Obscuration devices are often filled with a desired powder by pouring the powder into a cavity of the obscuration device. Such filling processes, however, only result in a 5-20% packing density. Since the size of the obscuration cloud is directly related to the packing density of the obscuration payload in the obscuration device, it is often desirable in some applications to have higher packing densities.

In the development of obscuration devices with higher packing densities, powders on the order of nanoparticles have been employed. Nanoparticle production methods enable precisely engineered obscurants with nanometer level control over particle size and shape. Obscurant devices are typically packed with fine and high aspect ratio powders that include particles in the form of disks, rods and flakes. These types of powders produce higher figure of merit. However, the nanoparticle powders tend to clump up easily due to Vander Waal's and electro static forces, and other cohesive inter-particle forces, which makes packing obscurant devices a challenge.

In such applications where higher packing density is desired, the powder may be pressed intermittently and filled to achieve a packing density up to about 35%. But the pressing process in obtaining this higher packing density causes clumping or layering in the powder. Upon detonation of the obscuration device, clumped or layered powder affects the dissemination process and effectiveness of the obscuration cloud upon detonation of the obscuration device by producing hunks or streaks instead of a nice uniform cloud. Thus, powder clumping together during the filling process of the obscuration device is a major practical challenge to achieving high efficiency with such fine obscurant particles.

There exists a need of providing tactical obscurant devices that have high packed density powders that completely aerosolize into large clouds during dissemination. There is also a need to provide high packing density powders in tactical obscurant devices to enable the powder to be aerosolized or disseminated to generate a uniform screening system upon detonation to affect electromagnetic wave propagation at various parts of the spectrum. There is further a need for a process to fill tactical obscurant devices with powders to provide high packing density with efficient aersolization upon detonation.

SUMMARY OF THE INVENTION

The present invention is directed toward an obscurant device having an obscurant payload comprising a packed powder material, the packed powder material comprising a plurality of powder particles packed within the obscurant device at a high packing density such that the packed powder material is capable of being aerosolized or disseminated upon detonation to generate a large cloud to affect electromagnetic wave propagation at one or more parts of the electromagnetic spectrum.

The present invention is also directed toward a method of packing an obscurant device with an obscurant payload comprising a powder material to provide a high packing density of the obscurant payload, such that the packed powder material is capable of being aerosolized or disseminated upon detonation to generate a large cloud to affect electromagnetic wave propagation at one or more parts of the electromagnetic spectrum.

In some aspects, the powder material is packed within the obscurant device to provide an obscurant payload by filling a cavity of the obscurant device with a plurality of powder particles and packing the plurality of powder particles using a pulsed dynamic pressing process. In some aspects, the pulsed dynamic pressing process employs radial pressing with sub-millisecond pulse pressure by dynamic magnetic compaction. In some aspects, packing the obscurant device with the powder material is achieved without conventional intermittent pressing. In some aspects, packing the obscurant device with the powder material is achieved on a dry basis without using any solvents.

In some aspects, the present invention is directed toward an obscurant device having an obscurant payload comprising two or more layers of packed powder material, each layer of packed powder material comprising a plurality of powder particles packed within the obscurant device at a high packing density, and each of the two or more layers separated from an adjacent layer by an intermittent material layer. In some aspects, the intermittent material layer is a paper fiber layer. In some aspects, the two or more layers of packed powder material comprise the same powder material. In some aspects, at least two layers of the two or more layers of packed powder material comprise a different powder material.

In some aspects, the obscurant device has an obscurant payload comprising three or more layers of packed powder material, each layer of packed powder material comprising a plurality of powder particles packed within the obscurant device at a high packing density, each of the three or more layers separated from an adjacent layer by an intermittent material layer, and each of the three or more layers of packed powder material comprising the same powder material.

In some aspects, the obscurant device has an obscurant payload comprising three or more layers of packed powder material, each layer of packed powder material comprising a plurality of powder particles packed within the obscurant device at a high packing density, each of the three or more layers separated from an adjacent layer by an intermittent material layer, and at least two layers of the three or more layers of packed powder material comprising a different powder material.

The present invention is also directed toward a method of packing powder material within an obscurant device to provide an obscurant payload comprising two or more layers of a high packing density of powder material, such that the packed powder material is capable of being aerosolized or disseminated upon detonation to generate a large cloud to affect electromagnetic wave propagation at one or more parts of the electromagnetic spectrum. In some aspects, a first layer of powder material is packed within the obscurant device by providing a plurality of powder particles within a cavity of the obscurant device and packing the plurality of powder particles using a pulsed dynamic pressing process to produce the first layer of packed powder material. In some aspects, an intermittent material layer, such as a paper fiber layer, is placed within the cavity adjacent the first layer of packed powder material. In some aspects, a second layer of powder material is packed within the obscurant device by providing a plurality of powder particles within the cavity of the obscurant device proximate the intermittent material layer and packing the plurality of powder particles using a pulsed dynamic pressing process to produce the second layer of packed powder material, such that the intermittent material layer separates the first and second layers of packed powder material. In some aspects, the pulsed dynamic pressing process employs radial pressing with sub-millisecond pulse pressure by dynamic magnetic compaction. In some aspects, packing the obscurant device with the powder material is achieved without conventional intermittent pressing.

In some aspects, the plurality of powder particles can be provided in a dry form such that the obscurant payload comprising one or more packed layers can be provided without requiring the use of solvents, which can increase the reliability and shelf life of the obscurant device. In some aspects, the obscurant payload is formed within the obscurant device using a plurality of powder material in a dry form without the use of solvents. In some aspects, the method of forming the obscurant payload is devoid of any solvent. In some aspects, the obscurant payload is devoid of any residual solvent from the powder packing process.

In some aspects, the plurality of powder particles is in the form of spheres, disks, rods, flakes and combinations thereof.

In some aspects, the plurality of powder particles comprise a titanium-containing compound. In some aspects, the plurality of powder particles comprises a titanium oxide, such as titanium dioxide ($TiO_2$). In some aspects, the plurality of powder particles comprises a coated titanium oxide. In some aspects, the titanium oxide is $TiO_2$ coated with diphenyldimethoxysilane, diphenyldiethoxysilane, or combinations thereof. In some aspects, the plurality of powder particles comprises a $TiO_2$ powder resonant acoustically mixed with one or more concentrations of fumed silica. In some aspects, the plurality of powder particles comprises a $TiO_2$ powder with surfaces treated with alumina.

In some aspects, the plurality of powder particles comprise a brass material. In some aspects, the plurality of powder particles comprises coated brass material. In some aspects, the brass material is coated with diphenyldimethoxysilane, diphenyldiethoxysilane, or combinations thereof. In some aspects, the plurality of powder particles comprises a brass material mixed with $TiO_2$ powder.

In some aspects, the plurality of powder particles comprises a nano fumed hydrophobic silica material. In some aspects, the nano fumed hydrophobic silica material has an average particle size between about 7 and about 20 nanometers. In some aspects, the nano fumed hydrophobic silica material comprises silica modified with silanes or siloxanes, in some aspects by polydimethylsiloxane.

In some aspects, the powder component is packed within the obscurant device at a fill density of at least about 40%, at least about 45%, at least about 50%, and in some aspects at least about 55%. In some aspects, the powder component is packed within the obscurant device at a fill density up to about 65%, up to about 70%, up to about 75%, and in some aspects up to about 80%. In some aspects, the powder component is packed within the obscurant device at a fill density in the range of at least about 40% and up to about 80%, in some aspects at least about 40% and up to about 75%, in some aspects at least about 40% and up to about 70%, and in some aspects at least about 40% and up to about 65%.

In some aspects, the obscurant payload is capable of providing screening in at least a portion of the electromagnetic spectrum, including the visible spectrum (approximately 0.38 μm to approximately 0.78 μm), the near infrared spectrum (NIR) (approximately 0.78 μm to approximately 3 μm), the mid infrared spectrum (MIR) (approximately 3 μm to approximately 50 μm), the far infrared spectrum (FIR) (approximately 50 μm to approximately 1000 μm), or a combination thereof.

In some aspects, the obscurant device is a grenade or other small-scale, tactical combat device. In some aspects, the obscurant device is a rocket, mortar, smokepots or other large-scale artillery combat device. In some aspects, the obscurant device a M106 hand grenade. In some aspects, the obscurant device is a M76 vehicle grenade.

In some aspects, an obscurant grenade having an obscurant payload having a high packing density of at least 40% provides an obscuration cloud having a size of at least about 15%, and in some aspects at least about 20%, greater than an obscurant cloud of a comparable obscurant grenade prepared using the same obscurant material loaded into the obscurant device by press filing to a packing density up to 35% to provide the obscurant payload.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
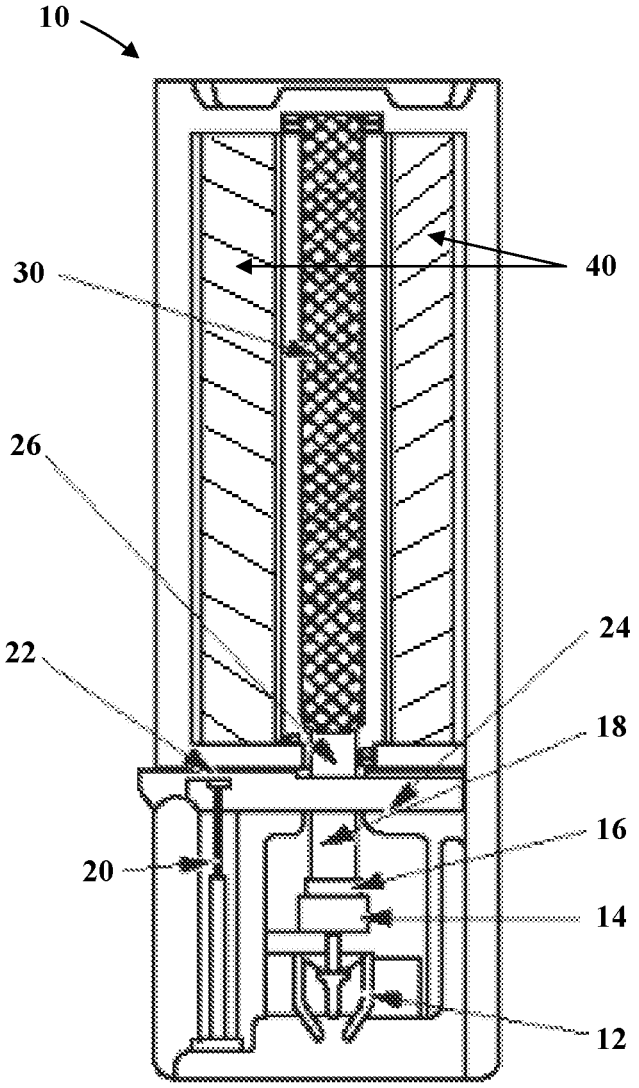
FIG. 1 is a schematic of an obscurant device having a high packed density obscurant payload according to certain aspects of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The embodiments herein and the various features and advantageous details thereof are explained more fully with reference to the non-limiting embodiments that are illustrated in the accompanying drawings and detailed in the following description. Description of well-known components and processing techniques are omitted so as to not unnecessarily obscure the embodiments herein. The examples used herein are intended to merely facilitate an understanding of ways in which the embodiments herein may be practiced and to further enable those of skill in the art to practice the embodiments herein without intending to limit the scope of the present invention. Accordingly, the examples should not be construed as limiting the scope of the embodiments herein.

The term "packing density" as used herein means the fraction of the obscurant payload density relative to the theoretical density possible for the obscurant payload.

The embodiments herein provide a technique and process to provide an obscurant payload within an obscurant device, such that the obscurant payload comprises a packed powder material at a packing density of at least 40% by a pulsed dynamic pressing process. Referring now to FIG. 1, the non-limiting embodiment of an M76 obscurant grenade 10 is shown to have a center burster 30 surrounded by the obscurant payload 40 of the present invention.

The obscurant grenade 10 is propelled from the discharger when an electrical current at the firing contact 12 activates the electrical match 14. The electrical match 14 ignites the propellant 16, which both launches the grenade and ignites the pyrotechnic time delay detonator 18. Launch acceleration causes the setback lock 20 to displace aft, out of engagement with the safe and arm slider/bore rider 22. When the slider/bore rider 22 clears the launch tube, it moves into the armed position, which aligns the transfer lead 24 with the time delay detonator and the booster lead 18. When the time delay detonator 18 ignites the transfer lead 24, booster lead 26, and central burster 30, the grenade bursts, disseminating the obscurant payload 40 into a cloud.

Figure 2:
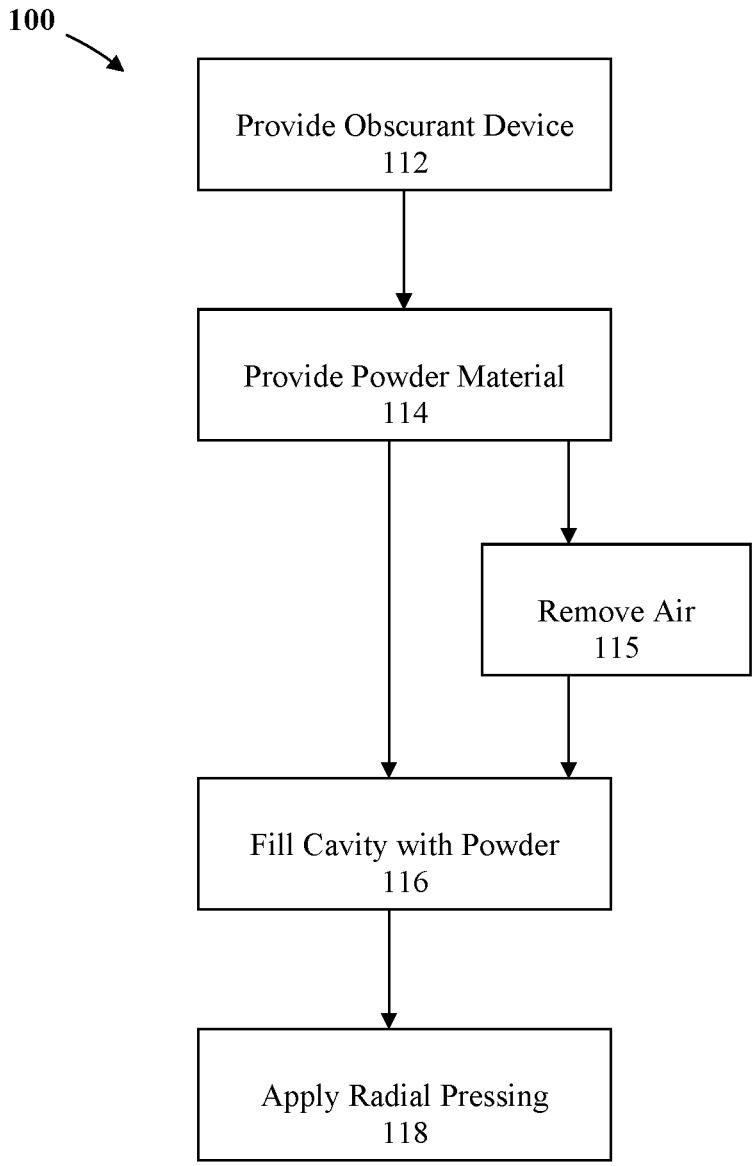
FIG. 2 is a flow diagram illustrating the formation of an obscurant device having a high packed density obscurant payload according to certain aspects of the present invention.

The obscurant payload 40 comprises a plurality of powder particles packed within a cavity of the obscurant device, wherein the obscurant payload 40 is capable of being aerosolized or disseminated upon detonation to generate a large cloud to affect electromagnetic wave propagation at one or more parts of the electromagnetic spectrum. The plurality of powder particles can be packed within the obscurant device using the method 100 illustrated in FIG. 2. The desired obscurant device is provided 112, which typically has a cavity for providing the desired powder material 114 to comprise the obscurant payload. The desired powder material can filled into the cavity of the obscurant device 116. In some aspects, the plurality of powder particles are filled around a central mandrel within the cavity of the obscurant device. In some aspects, before the powder material is filled into the cavity as much air as possible is removed from the powder material 115. Removal of air from the powder material may be accomplished using a weight system and vibration to introduce more powder material and reduce the trapping of air when filling the cavity, which helps prevent the formation of air pockets in the powder material during the filling step 116. Such a filling process also eliminates the plurality of powder particles from puffing up within the cavity. Upon filling the cavity, the plurality of powder particles may be pressed radially using a pulsed dynamic pressing process 118.

Figure 3B:
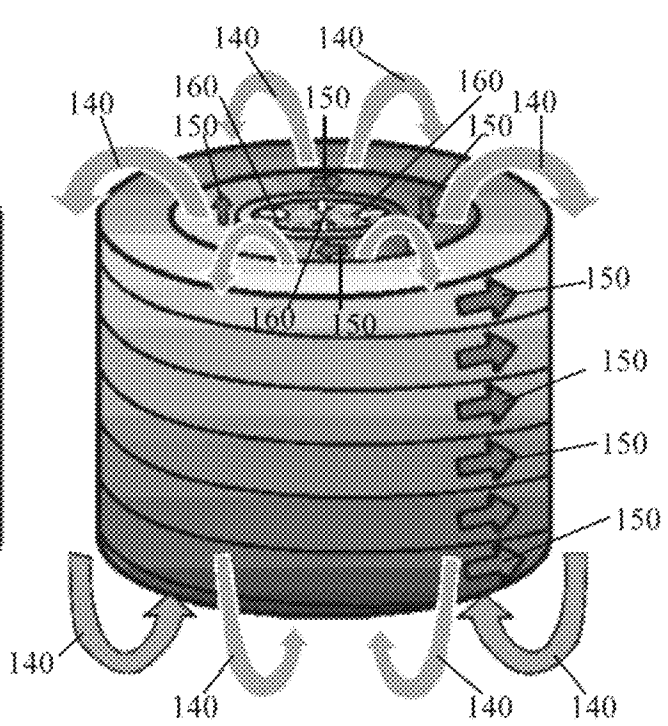
FIGS. 3A-3B are schematics of the dynamic magnetic compaction process principle employed to provide an obscurant payload according to certain embodiments of the present invention.
Figure 3A:
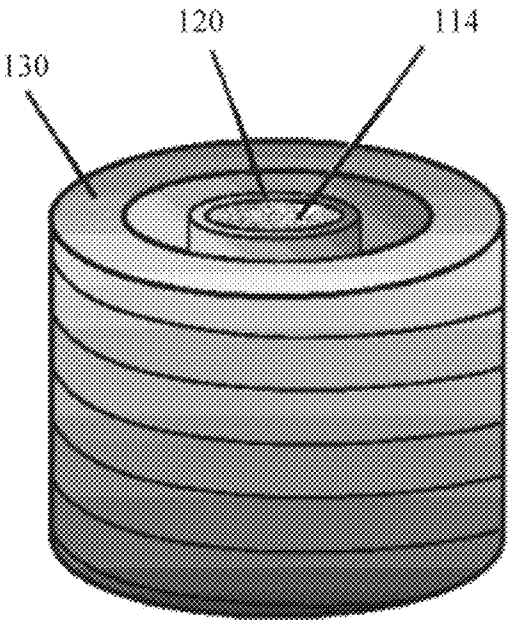

The pulsed dynamic pressing process preferably employs radial pressing with sub-millisecond pulse pressure by dynamic magnetic compaction. The principle of radial dynamic magnetic compaction utilized on the desired powder material to provide the obscurant payload having a packing density of at least 40% is illustrated in the schematics of FIGS. 3A-3B. In FIG. 3A, the desired powder material 114 is filled in a conductive container 120, such as an armature, which is placed in the bore of a coil 130 that is capable of providing a high field press. As illustrated in FIG. 3B, currents are passed through the coil 130 to produce a magnetic field 140 in the bore which, in turn, induces currents 150 in the conductive container 120. The induced currents 150 interact with the applied magnetic field 140 to produce an inwardly directed magnetic force 160 that collapses the conductive container 120 at a high velocity and compacts the powder in less than a millisecond. By tuning the magnitude of the currents, the pressure on the conductive container 120 is adjusted to achieve uniform powder density without forming aggregates.

The dynamic magnetic compaction applies pressures on the plurality of powder particles by non-contact electromagnetic forces. The plurality of powder particles are capable of being packed within the cavity by dynamic magnetic compaction in a time frame of about 2 to about 10 milliseconds, preferably about 3 to about 8 milliseconds. In some aspects, packing the obscurant device with the powder material to obtain the obscurant payload within the obscurant device is achieved without conventional intermittent pressing.

In another preferred embodiment, the obscurant payload 40 can comprise more than one layer of powder material. Each layer of powder material can be compacted using dynamic magnetic compaction. In some aspects, a first layer of powder material is compacted using dynamic magnetic compaction, then a second layer is filled over the first layer and compacted using dynamic magnetic compaction. The use of dynamic magnetic compaction can be used to provide build multiple layers of an obscurant payload 40.

Figure 4B:
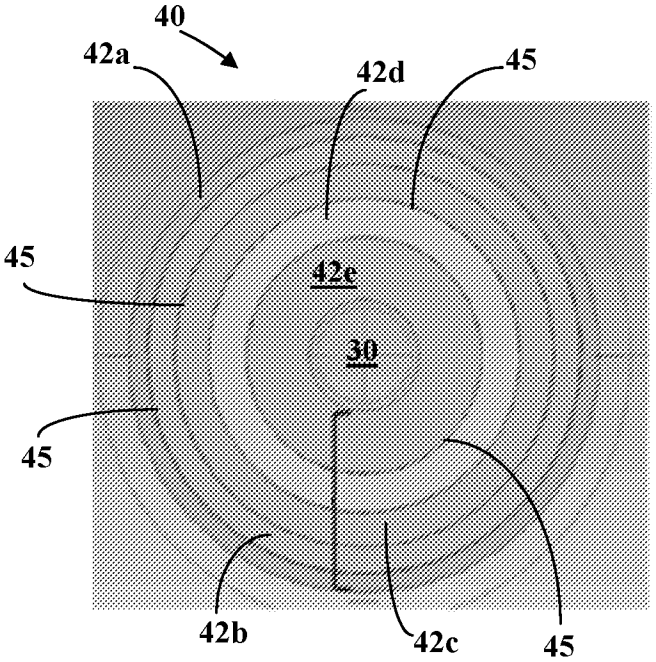
FIG. 4B is top cross-sectional schematic of the multi-layer obscurant payload of FIG. 4A according to certain aspects of the present invention.
Figure 4A:
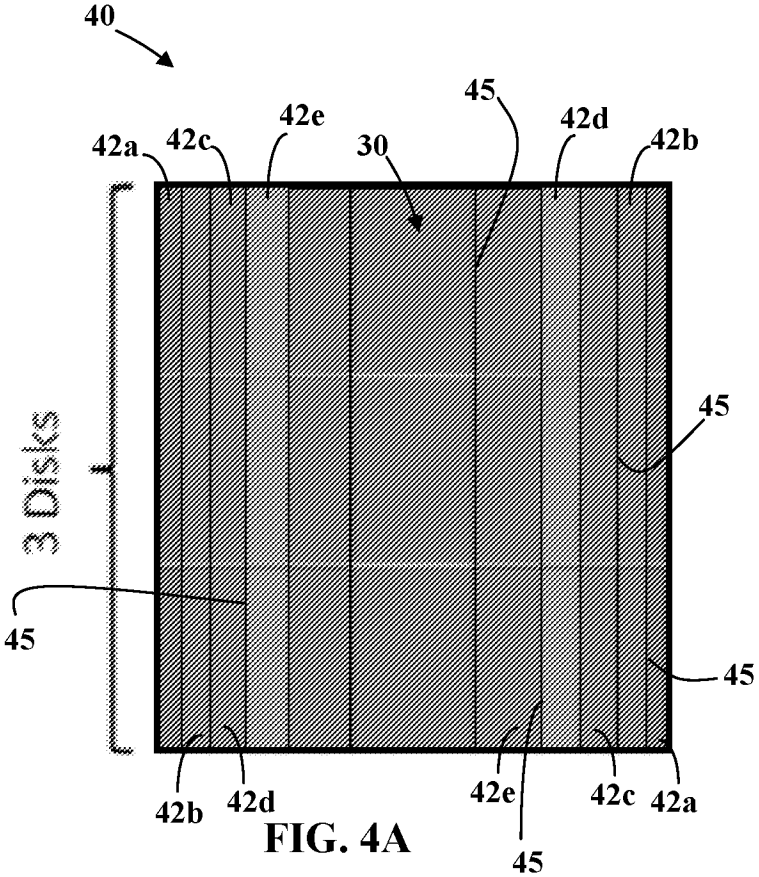
FIG. 4A is side cross-sectional schematic of a multi-layer of an obscurant payload and central charge of an obscurant device according to certain aspects of the present invention.

For example, as illustrated in FIGS. 4A and 4B, the obscurant device can have an obscurant payload 40 comprising five layers 42*a*, 42*b*, 42*c*, 42*d* and 42*e* of powder material. It is contemplated by the present invention that the obscurant payload can comprise more than one layer of packed powder material, such as two or more layers of packed powder material, or a plurality of layers of packed powder material.

Each respective layer of packed powder material may be provided by using the pulsed dynamic pressing process to pack a plurality of powder particles into the respective layer. In some aspects, each layer of packed powder material comprises the same powder material. In some other aspects, the obscurant payload comprises at least two layers of packed powder material that comprises different powder material. In some aspects, the obscurant payload comprising at least two layers of packed powder material, each of the two layers of packed powder material comprising different powder materials that affect electromagnetic wave propagation at different parts of the electromagnetic spectrum.

It is also contemplated that one layer of powder material may be a packed powder layer that is provided within the obscurant device by method 100 while one or more other layers of powder material may be unpacked and/or packed by a different process than a pulsed dynamic pressing process.

In an embodiment, each layer of powder material is separated from an adjacent layer of powder material by an intermittent material layer. In some aspects, the intermittent material layer is a paper fiber layer. In a preferred embodiment, a first layer of packed powder material is separated from an adjacent second layer of powder material by a paper fiber layer. In another preferred embodiment, a first layer of packed powder material is separated from an adjacent second layer of packed powder material by a paper fiber layer. In yet another preferred embodiment, the obscurant payload comprises a plurality of packed powder material layers, with each packed powder material layer separated from an adjacent layer by a paper fiber layer.

In some preferred aspects, the paper fiber layer comprises paperboard, preferably kraft paper fiberboard. In some aspects, the paper fiber layer comprises kraft paper fiberboard in cylindrical, hollow tubes. In some aspects, the paperboard is between about 8 pt. (0.008 inches) and about 36 pt. (0.036 inches), in some aspects between about 10 pt. (0.010 inches) and about 36 pt. (0.036 inches), and in some other preferred aspects between about 12 pt. (0.012 inches) and about 36 pt. (0.036 inches). In some other preferred aspects, the paper fiber layer has minimal air layered within the paper fibers. In some preferred aspects, the paper fiber layer does not comprise a corrugated structure. In some aspects, the paper fiber layer provides a boundary between adjacent powder material layers, preferably adjacent packed powder material layers. Without wishing to be bound by theory, the paper fiber layer may create boundaries between adjacent powder material layers to produce local disturbances for shock wave propagation, such that shock waves are more scattered to break up the powder material when the shock waves collide with the paper fiber layer.

In the embodiment of two or more layers of powder material, the paper fiber layer is inserted within the cavity of the obscurant device after a respective layer of powder material is filled into the cavity, preferably after the respective layer of powder material filled into the cavity and packed using a pulsed dynamic pressing process. One of ordinary skill in the art will appreciate that the outer layer of powder material is preferably filled within the cavity followed by the a first paper fiber layer and then subsequent powder material layers and paper fiber layers until the desired layers of powder material are provided within the cavity of the obscurant device.

Referring now to the embodiment illustrated in FIGS. 4A and 4B, a concentrically packed obscurant payload 40 is illustrated comprising powder material layers 42*a*, 42*b*, 42*c*, 42*d* and 42*e*. Each respective powder material layer is preferably provided within the cavity of the obscurant device before the adjacent powder material layer. For instance, powder material 42*a* is preferably provided within the cavity followed by layer 42*b*, then 42*c*, then 42*d*, and then 42*e*, with a paper fiber layer provided in between each of 42*a* and 42*b*, 42*b* and 42*c*, 42*c* and 42*d*, and 42*d* and 42*e*. In a preferred embodiment, each powder layer 42*a*-42*e* is packed within the cavity using the pulsed dynamic pressing process discussed above before the intermittent paper fiber layer 45 and adjacent powder material layer is introduced into the cavity. In an alternative aspect, the powder material that comprises each of layers 42*a*-42*e* and respective intermittent paper fiber layers 45 between each of the powder materials are introduced into the cavity and then a single pulsed dynamic pressing process is employed to pack each of layers 42*a*-42*e* simultaneously. After the obscurant payload 40 is provided within the cavity of the obscurant device, the explosive material may be placed within the cavity. As shown in FIGS. 4A-4B, the explosive material comprises a center burster 30 that is placed in the middle of the concentrically arranged powder material layers 42*a*-42*e*. In some aspects, a paper fiber layer 45 may be placed between the powder material layer 42 and the explosive material 30, such as powder material layer 42*e* and center burster 30 shown in FIGS. 4A-4B.

FIG. 4A also illustrates that the obscurant pay load can comprise three disks, such that it is contemplated by the present invention that the obscurant payload can comprise two or more disks. Each disk may be separated from an adjacent disk by an intermittent layer, such as a paper fiber layer. FIG. 4A illustrates that each of the three disks comprises the same multi-layered obscurant payload. It is also contemplated that at least two disks comprising an obscurant payload comprise a different powder material or powder material packing structure. For instance, the middle disk may comprise a multi-layered structure, such as shown in FIGS. 4A-4B, while the top disk, bottom disk or both comprise a single powder material or two or more powder material, which may be packed by the pulsed dynamic pressing process. In another embodiment, the obscurant payload may comprise a first disk comprising a first concentrically packed powder structure and a second disk comprising a second concentrically packed powder structure that is different from the first concentrically packed powder structure. In yet another embodiment, the obscurant payload may comprise a first disk comprising a first concentrically packed powder structure having a first packing density and a second disk comprising a second concentrically packed powder structure having a second packing density, wherein at first packing density is different than the second packing density. As one of ordinary skill of art will appreciate from the present disclosure, a multi-layered packed obscurant payload may be provided within an obscurant device, such that multiple types of powder material may be provided for multispectral obscuration.

The plurality of powder particles are preferably formed into the obscurant payload in the dry form, such that the obscurant payload comprising one or more packed layers can be provided without requiring the use of solvents. In some aspects, the plurality of powder particles are filled filled into the cavity in a dry form, and the dynamic magnetic compaction process is utilized to provide the obscurant payload without the use of any solvents. The elimination of solvents not only increases the efficiency of forming the obscurant payload, but also increases the reliability and shelf life of the obscurant device. More preferably, the obscurant payload is formed within the obscurant device using a plurality of powder material in a dry form without the use of any solvents, such that the obscurant payload is not only devoid of any solvent, but any devoid of any residual solvent from the powder packing process.

The plurality of powder material particles is preferably in the form of spheres, disks, rods, flakes and combinations thereof.

In some aspects, the plurality of powder particles comprise a titanium-containing compound. In some aspects, the plurality of powder particles comprises a titanium oxide, such as titanium dioxide ($TiO_2$). In some aspects, the $TiO_2$ powder is treated with alumina, such as TiONA RCL-9™ (CAS No. 13463-67-7) from Cristal Inc. Other exemplary commercially coated $TiO_2$ powders treated with an inorganic coating such as alumina include R700, R706, R900, R931 and R101 (available from DuPont), Tiona 595, 596, 188, RCL-4 (available from Millenium), and CR-470, CR-813, CR-826 and CR-834 (available from Tronox). In some aspects, the plurality of powder particles comprises a coated titanium oxide. In some aspects, the titanium oxide is $TiO_2$ coated with a hydrophobic organosilane, diphenyldimethoxysilane (DPDMS), n-octyltriethoxysilane (n-OTES), n-octadecyltrimethoxysilane (nODTMS) and tridecafluoro-1,1,2,2-tetrahydroctyltrimethoxysilane (TDFTMS), or one or more hydrophilic polyols such as trimethylolethane (TME) and trimethylolpropane (TMP). In some aspects, the titanium oxide is $TiO_2$ coated with such as the dialkylsilane DPDMS, diphenyldiethoxysilane, or combinations thereof. In some aspects, the plurality of powder particles comprises a $TiO_2$ powder resonant acoustically mixed with one or more concentrations of fumed silica. In some aspects, the plurality of powder particles comprises a $TiO_2$ powder coated with about 1.0 wt-% to about 3.0 wt-% of silica.

In some aspects, the $TiO_2$ particles have a particles size of less than 10 μm, less than about 9 μm, and in some aspects less than about 8 μm. In some aspects, the $TiO_2$ particles have a particles size between about 0.10 μm and about 10 μm, between about 0.10 μm and about 9 μm, and in some aspects between about 0.20 μm and about 8 μm.

In some aspects, the plurality of powder particles comprise a brass material. In some aspects, the plurality of powder particles comprises coated brass material. In some aspects, the brass material is coated with diphenyldimethoxysilane, diphenyldiethoxysilane, or combinations thereof. In some aspects, the brass material is coated with diphenyldimethoxysilane, diphenyldiethoxysilane, or combinations thereof, with resonant acoustic mixer treatment to help separate the disseminated particles. In some aspects, the plurality of powder particles comprises a brass material mixed with $TiO_2$ powder. In some aspects, the plurality of powder particles comprises $TiO_2$ mixed with between about 5 wt-% and about 30 wt-% brass. In some aspects, the plurality of powder particles comprises $TiO_2$ coated with diphenyldimethoxysilane, diphenyldiethoxysilane, or combinations thereof, mixed with between about 5 wt-% and about 30 wt-% brass. An exemplary brass powder material is Product 4000 available from AVL Metal Powders, which as the lower and upper limit values at the particle distribution value of D10 at 4 and 7 μm, D50 at 16 and 23 μm, and D90 at 36 and 52 μm.

In some aspects, the plurality of powder particles comprises a nano fumed hydrophobic silica material. In some aspects, the nano fumed hydrophobic silica material has an average particle size between about 7 and about 20 nanometers. In some aspects, the nano fumed hydrophobic silica material comprises silica modified with silanes or siloxanes, in some aspects by polydimethylsiloxane.

In some aspects, the powder component is packed within the obscurant device at a fill packing density of at least about 40%, at least about 45%, at least about 50%, and in some aspects at least about 55%. In some aspects, the powder component is packed within the obscurant device at a fill packing density up to about 65%, up to about 70%, up to about 75%, and in some aspects up to about 80%. In some aspects, the powder component is packed within the obscurant device at a fill packing density in the range of at least about 40% and up to about 80%, in some aspects at least about 40% and up to about 75%, in some aspects at least about 40% and up to about 70%, and in some aspects at least about 40% and up to about 65%.

In some aspects, the powder component is packed within the obscurant device at a density greater than a standard device packed in a standard pressing manner, which has a density less than 2.00 g/cm$^3$. In some aspects, the powder component packed using the dynamic magnetic compaction of the present invention has a density greater than about 2.00 g/cm$^3$ and having a grenade figure of merit (gfom) greater than about 0.80. In some aspects, the powder component packed using the dynamic magnetic compaction of the present invention has a density greater than about 2.25 g/cm$^3$ and having a grenade figure of merit (gfom) greater than about 0.85. In some aspects, the powder component packed using the dynamic magnetic compaction of the present invention has a density greater than about 2.50 g/cm$^3$ and having a grenade figure of merit (gfom) greater than about 0.90. In some aspects, an explosive energy of the center burster material in the obscurant device produced by the dynamic magnetic compaction of the present invention is greater than the explosive energy of the center burster material in a standard production device that typically uses lower energy propellants to obtain comparable gfoms due to the obscurant devices having a higher density, but the higher density devices will create a larger obscurant cloud upon detonation.

In some aspects, the powder to charge mass ratio of the obscurant device of the present invention is greater than about 25, in some aspects greater than about 30, in some aspects greater than about 35, in some aspects greater than about 40, in some aspects greater than about 45, in some aspects greater than about 50, and in some preferred aspects greater than about 55. In some aspects, the ratio of the powder mass of the obscurant device to the burster-charge mass (powder:charge) is between about 50 and about 85, in some aspects between about 60 and about 85, and in some preferred aspects between about 65 and about 80.

In some aspects, the obscurant payload is capable of providing screening in at least a portion of the electromagnetic spectrum, including the visible spectrum (approximately 0.38 μm to approximately 0.78 μm), the near infrared spectrum (NIR) (approximately 0.78 μm to approximately 3 μm), the mid infrared spectrum (MIR) (approximately 3 μm to approximately 50 μm), the far infrared spectrum (FIR) (approximately 50 μm to approximately 1000 μm), or a combination thereof.

In a preferred embodiment, the obscurant device comprises an obscurant payload comprising a multi-layered packed powder structure that is capable of providing screening in two or more electromagnetic spectrum regions chosen from the visible spectrum (approximately 0.38 μm to approximately 0.78 μm), the near infrared spectrum (NIR) (approximately 0.78 μm to approximately 3 μm), the mid infrared spectrum (MIR) (approximately 3 μm to approximately 50 μm), and the far infrared spectrum (FIR) (approximately 50 μm to approximately 1000 μm).

In some aspects, the obscurant device has an obscurant payload having a high packing density of at least 45% that is capable of providing an obscuration cloud having a size of at least about 10%, in some aspects at least about 15%, and in some aspects at least about 20%, greater than an obscurant cloud of a comparable obscurant device prepared by to a packing density less than about 35%.

In some aspects, the obscurant device has an obscurant payload having a high packing density of at least 45% that is capable of providing an obscuration cloud having a size of at least about 10%, in some aspects at least about 15%, and in some aspects at least about 20%, greater than an obscurant cloud of a comparable obscurant device prepared by to a packing density less than about 35%, and a void area proximate the center of the obscurant cloud that is less than 50%, in some aspects less than about 45%, in some aspects less than 40%, and in some aspects less than 35% of the void area of a comparable obscurant device utilizing the same material for the obscurant payload having a packing density less than about 35%.

In some aspects, the obscurant device is a grenade or other small-scale, tactical combat device. In some aspects, the obscurant device is a rocket, mortar, smokepots or other large-scale artillery combat device.

EXAMPLE

Example 1—Grenades of Different Construction Methods

Different concepts for dynamic magnetic compaction construction methods were experimented to understand the propagation of explosive waves and their reflections to create micro shear in the powders. Three construction methods were chosen for fabricating full sized pre prototype M106 grenades for screening tests. Each of the three construction methods utilized $TiO_2$ powder particles (TiONA® RCL-9 from CRISTAL) as the obscurant payload.

A comparison M106 obscurant grenade having a conventional obscurant payload of $TiO_2$ powder particles was produced using a conventional press utilizing a conventional intermittent press filing technique, which provided a center burster grenade with the obscurant payload having a packing density of less than 25%.

A first DMC M106 obscurant grenade was produced comprising three stacked obscurant pucks to achieve the axial length of the grenade, each obscurant puck having an obscurant payload of compacted $TiO_2$ powder particles that was made using a single compaction step. Each obscurant puck was produced by lining an armature with a paper fiber tube and then providing a plurality of $TiO_2$ powder particles within the cavity of the armature. Before the plurality of $TiO_2$ powder particles were inserted into the cavity of the armature, a weight system and vibration was employed to reduce the amount of air trapped within the powder material. The powder material was filled uniformly around a central mandrel and pressed radially against the paper fiber tube using dynamic magnetic compaction to yield a center burster grenade with the obscurant payload having a packing density of about 45%. The central mandrel was removed after the packing of each obscurant puck was complete to create a center hole for the explosive material. Loose $TiO_2$ powder particles filled in the remaining space between the outer paper fiber case and the compacted obscurant pucks within the obscurant grenade.

A second DMC M106 obscurant grenade was produced comprising three stacked obscurant pucks to achieve the axial length of the grenade, each obscurant puck having an obscurant payload of compacted $TiO_2$ powder particle having a continuous boundary within the obscurant payload that was made using two compaction steps. Each obscurant puck was produced by lining an armature with a paper fiber tube and then providing a plurality of $TiO_2$ powder particles within the cavity of the armature. Before the plurality of $TiO_2$ powder particles were inserted into the cavity of the armature, a weight system and vibration was employed to reduce the amount of air trapped within the powder material. The powder material was filled uniformly around a central mandrel and pressed radially using dynamic magnetic compaction. After compaction an intermittent paper fiber layer was placed around the compressed material and additional powder material was filled uniformly around the compressed material, which was then again pressed radially a second time using dynamic magnetic compaction to yield a center burster grenade with the obscurant payload having a packing density estimate for each layer shown in Table 1. The central mandrel was removed after the packing was complete to create a center hole for the explosive material. Loose $TiO_2$ powder particles filled the remaining space between the outer paper fiber case and the compacted obscurant pucks of the obscurant grenade.

TABLE 1

Density Estimate for Second DMC M106 Obscurant Layers.

| | Inner Layer | | | | Outer Layer | | | | Loose Powder | |
|---|---|---|---|---|---|---|---|---|---|---|
| Material | Inner (g/cc) | Mass (g) | Dia (inch) | % Th | Outer (g/cc) | Mass (g) | Dia (inch) | % Th | (g/cc) | % Th |
| $TiO_2$ | 3.66 | 24 | 1.01 | 86.52 | 2.26 | 95 | 2.07 | 53.43 | 0.846 | 20 |

The same explosive material and quantity of explosive material was provide in the central hole for each of the comparison M106, first DMC M106 and second DMC M106 with the intermittent boundary layer. Each of the M106 obscurant grenades were detonated under the same conditions and recorded by video.

Figure 5A:
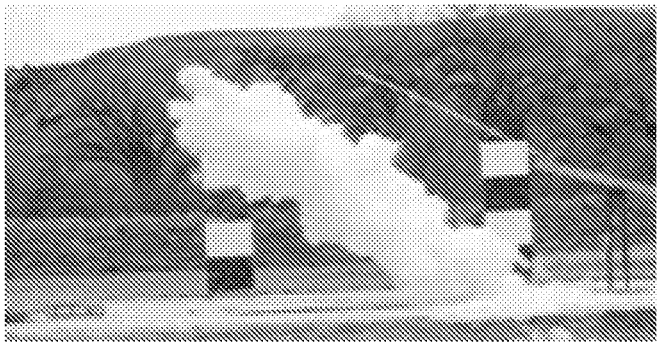
FIG. 5A is a video photograph of an obscurant cloud of a detonated center burster obscurant M106 grenade having the obscurant payload filled to a packing density between about 30-35% according to a conventional press filling process.
Figure 5B:
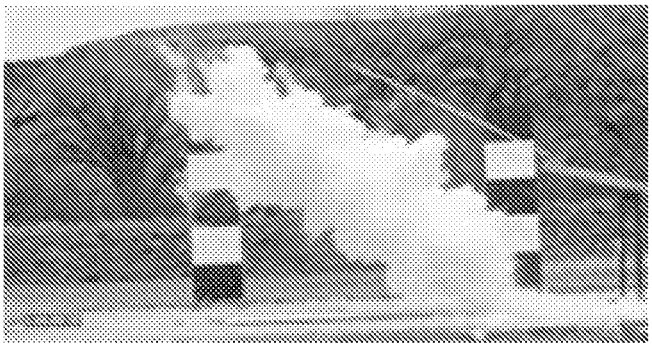
FIG. 5B is a video photograph of an obscurant cloud of a detonated center burster obscurant M106 grenade having the obscurant payload filled to a packing density greater than 40% using radial dynamic magnetic compaction process, according to certain aspects of the present invention.
Figure 5C:
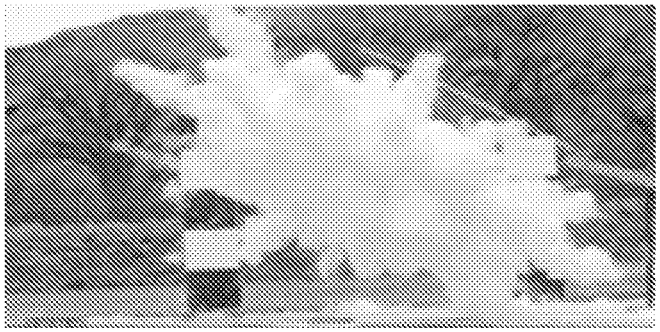
FIG. 5C is a video photograph of an obscurant cloud of a detonated center burster obscurant M106 grenade having the obscurant payload filled to a packing density greater than 40% using radial dynamic magnetic compaction process with one intermittent paper layer boundary within the obscurant payload, according to certain aspects of the present invention.

A video photograph of the obscuration cloud formation of the comparison M106 obscurant grenade having the obscurant payload made using the conventional press filling method is shown in FIG. 5A. A video photograph of the first DMC M106 obscurant grenade having the obscurant payload made using the dynamic magnetic compaction process of the present invention is shown in FIG. 5B. A video photograph of the second experimental M106 obscurant grenade having the obscurant payload with a continuous boundary made using the dynamic magnetic compaction process of the present invention is shown in FIG. 5C. As shown in the photographs of FIGS. 5A-5B, the obscuration cloud formation from the M106 obscurant grenades having the obscurant payload made using the dynamic magnetic compaction process of the present invention had an increased obscurant cloud compared to the obscuration cloud formation of the comparison M106 obscurant grenade by at least about 15-20% or more. The obscurant payload made using the dynamic magnetic compaction process of the present invention and having a continuous boundary had an even greater obscuration cloud formation.

Example 2—DMC of a Brass Powder Obscurant Grenade

A DMC M106 obscurant grenade was produced comprising three stacked obscurant pucks to achieve the axial length of the grenade. Each of the obscurant pucks comprised an obscurant payload of compacted Brass powder particles (Product 4000 available from AVL Metal Powders) having a continuous boundary within the obscurant payload that was made using two compaction steps. Each obscurant puck was produced by lining an armature with a paper fiber tube and then providing a plurality of Brass powder particles within the cavity of the obscurant grenade. Before the plurality of Brass powder particles were inserted into the cavity of the armature, a weight system and vibration was employed to reduce the amount of air trapped within the powder material. The powder material was filled uniformly around a central mandrel and pressed radially using dynamic magnetic compaction. After compaction an intermittent paper fiber layer was placed around the compressed material and additional powder material was filled uniformly around the compressed material, which was then again pressed radially a second time using dynamic magnetic compaction to yield a center burster grenade with the obscurant payload having a packing density estimate for each layer shown in Table 2. The central mandrel was removed after the packing was complete to create a center hole for the explosive material. Loose Brass powder particles filled in the remaining space between the outer paper fiber case and the compacted obscurant pucks of the obscurant grenade.

TABLE 2

Density Estimate for Second DMC M106 Obscurant Layers.

| | Inner Layer | | | | Outer Layer | | | | Loose Powder | |
|---|---|---|---|---|---|---|---|---|---|---|
| Material | Inner (g/cc) | Mass (g) | Dia (inch) | % Th | Outer (g/cc) | Mass (g) | Dia (inch) | % Th | (g/cc) | % Th |
| Brass | 5.70 | 172.0 | 1.69 | 67.78 | 3.20 | 78.0 | 2.17 | 38.05 | 0.841 | 10 |

Example 3—Elimination of Center Hole in Obscurant Clouds

Figure 6A:
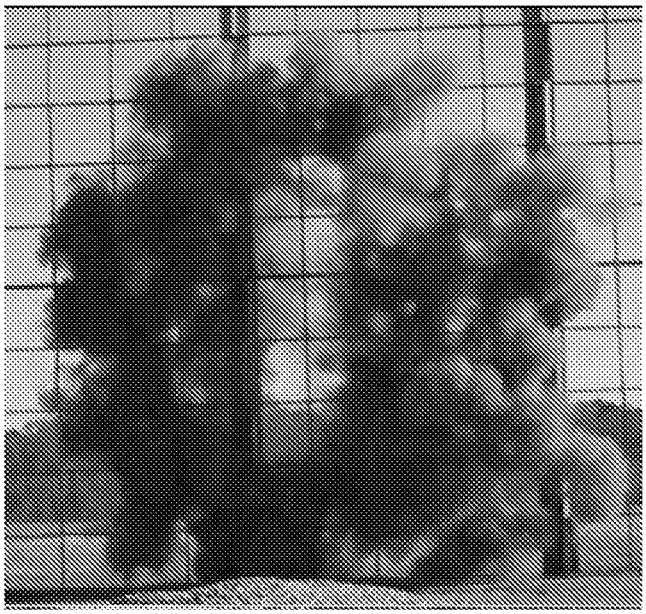
FIG. 6A is a video photograph of an obscurant cloud of a detonated center burster obscurant M76 grenade having the obscurant payload filled to a packing density between about 30-35% according to a conventional press filling process.

One desired feature of obscurant clouds formed from detonating obscurant devices is a uniform obscurant cloud without any devoid areas. One problem with the obscurant cloud resulting from detonating a conventional M76 grenade (obscurant payload comprising pressed Brass by the conventional press fill process) is a center hole proximate the center of the obscurant cloud as shown in FIG. 6A.

To address the devoid area proximate the center of the obscurant cloud, various obscurant payloads of Brass powder were loaded into a M76 grenade having a height of 0.181 meters using the dynamic magnetic compression process with different core tool geometries and loading methods, as provided in Table 3. Core #1 and Core #2 in Table 3 represent two different core geometries, and the term "Press Top" does not use a central core. Three pucks were used to make each grenade with the top puck formed using the method provided in Table 3. The other two pucks of each grenade were formed having a central hole for the explosive, such as the pucks produced in Example 2. For instance, the "DMC/Press Top" has the top puck created without the use of a central core, but the other two pucks have a central hole for the explosive, such as the central hole pucks provided in Example 2.

Videos of the cloud were taken upon detonation for each of the grenades. The range of the cloud was measured using cloud analysis. Kinovea video software was used to analyze the cloud at different times. The video was slowed down to 0.03 seconds per frame. Then each video was time stamped at the moment before the explosion occurred, and then continued to the point when the environment, or wind, began to influence the cloud. The device that had the earliest cloud interference dictated the duration of the other devices, which had interference occurring 0.67 s after the explosion. At this stopping point, Kinovea software was used to measure the cords of the cloud. The background lattice of one meter by one meter was used to scale the cloud size. Once the video cloud images were measured, they were imported into a Solidworks sketch. The same background lattice of 1 m×1 m was used to calibrate Solidworks sketch. The Solidworks results were checked against the Kinovea measurements. To outline the cloud image in the Solid works, Spline tool was used to outline the cloud to calculate the cloud surface area. For the void area, the openings in the cloud were traced and allowed the software to compute a total surface area. The results of the cloud analysis are shown in Table 3.

TABLE 3

Cloud Analysis of M76 Grenades.

| Device | Powder Mass (g) | Construction | Surface Area ($m^2$) | Void Area ($m^2$) | SA % Change | VA/VA (Prod) |
|---|---|---|---|---|---|---|
| Comp. | 1250 | Conventional Press | 53.931 | 8.31 | — | — |
| 1 | 1304 | DMC/Press Core #1 Top | 57.063 | 4.06 | 5.8 | 48.9 |
| 2 | 1342 | DMC/Press Core #1 Top | 58.840 | 5.45 | 9.1 | 65.6 |
| 3 | 1302 | DMC/Press Core #2 Top | 56.826 | 2.46 | 5.4 | 29.6 |
| 4 | 1323 | DMC/Press Core #2 Top | 53.986 | 4.11 | 0.1 | 49.5 |
| 5 | 1312 | DMC/Press Top | 55.806 | 3.63 | 3.5 | 43.7 |
| 6 | 1352 | DMC/Press Top | 56.691 | 2.73 | 5.1 | 32.9 |
| 7 | 1240 | DMC/Press Top | 64.283 | 3.64 | 19.2 | 43.8 |
| 8 | 1232 | DMC/Press Top | 59.088 | 2.34 | 9.6 | 28.2 |

It is noted that the Comparative device in Table 3 having 1250 g obscurant mass (Brass) has a density of about 3.08 g/cc (36.7% TH). The DMC sample targeting a total obscurant mass of 1250 g has an obscurant density of about 3.40 g/cc (40.4% TH) average compensating for the paperboard volume. The DMC sample targeting a total obscurant mass of 1350 g has an obscurant density of about 3.67 g/cc (43.7% TH) average compensating for the paperboard volume, with the theoretical density being about 8.41 g/cc based upon the inner layer obscurant density being about 5.70 g/cc (67.8% TH), the outer layer obscurant density being about 3.2 g/cc (38.1% TH), and the loose fill powder obscurant density being about 0.84 g/cc (10% TH).

Figure 6B:
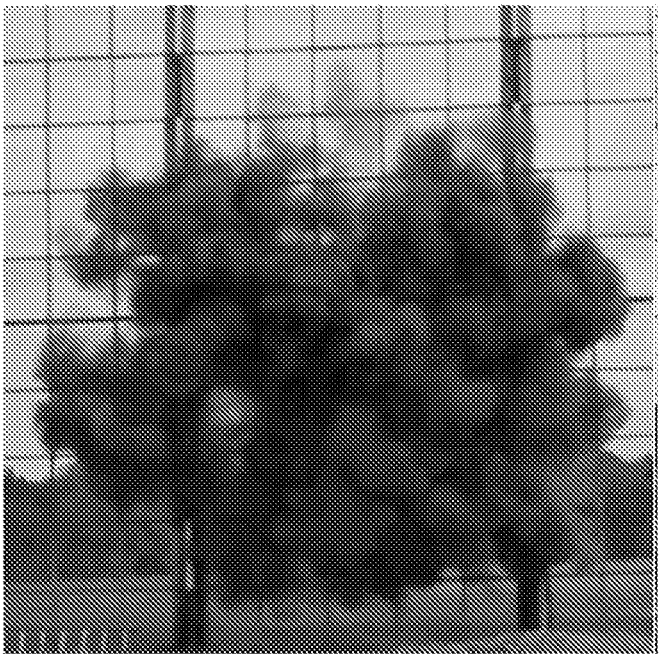
FIG. 6B is a video photograph of an obscurant cloud of a detonated center burster obscurant M76 grenade having the obscurant payload filled to a packing density greater than 40% using radial dynamic magnetic compaction process, according to certain aspects of the present invention.
Figure 7A:
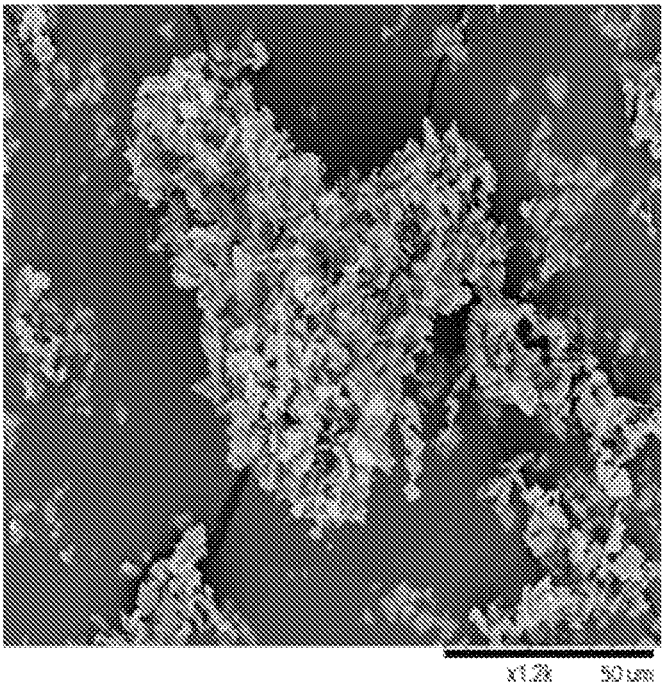
FIG. 7A is a micrograph of a floor sample of the $TiO_2$+5% brass obscurant payload from a grenade after detonation, the grenade packed using the conventional press filling method.
Figure 7B:
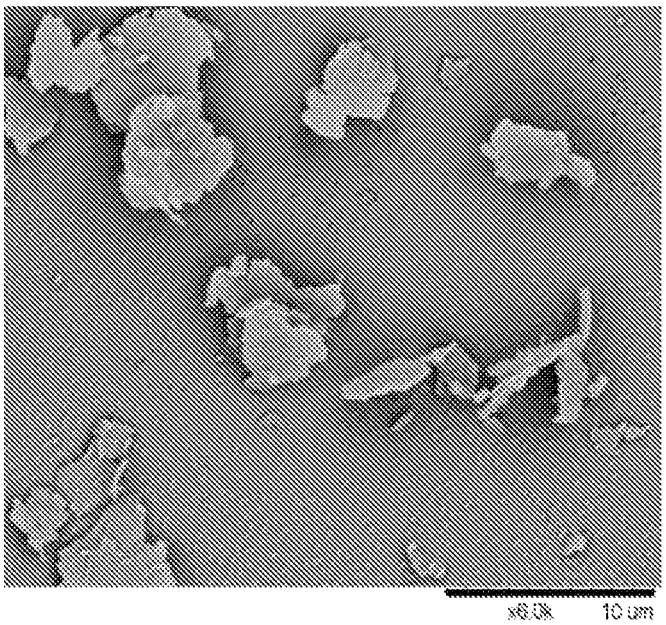
FIG. 7B is a micrograph of a floor sample of the $TiO_2$+5% brass obscurant payload from a grenade after detonation, the grenade packed using the dynamic magnetic compaction process according to certain embodiments of the present invention.
Figure 8:
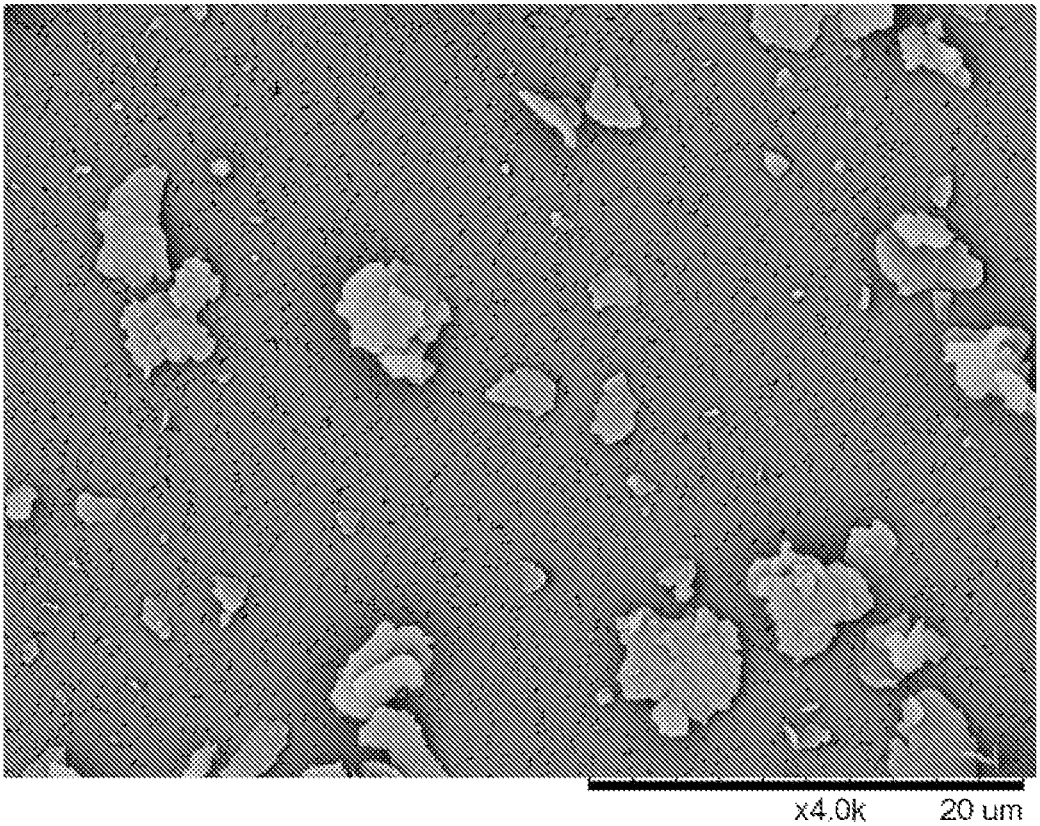
FIG. 8 is a micrograph of a floor sample of the $TiO_2$+5% brass obscurant payload from a grenade after detonation, the grenade packed using the dynamic magnetic compaction process according to certain embodiments of the present invention.

The results of the cloud analysis provided in Table 2 show that the performance depended on the construction method used to provide the obscurant payload. All of the M76 devices that used dynamic magnetic compression to provide the obscurant payload outperformed the standard obscurant payload provided by conventional press filling in cloud coverage. Also the void area was reduced in all of the M76 devices in comparison to the standard device. The different construction techniques using dynamic magnetic compression also showed some differences. For instance, dynamic magnetic compression using compacting ring devices (7 & 8) with a solid press cap showed the largest coverage area with smaller void area. In comparison to the production standard device, these two M76 devices, on the average, were 14% larger in coverage (with only 36% of the void area) of the standard device. An illustrative example of this larger coverage is shown between FIGS. 6A and 6B, wherein the obscurant cloud at 0.67 seconds after detonation for the Comparative device is shown FIG. 6A and a representative obscurant cloud at about 0.67 seconds after detonation without the central hole for the samples is shown in FIG. 6B.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of claim interpretation, it is expressly intended that the provisions of 35 U.S.C. § 112(f) are not to be invoked unless specific terms "means for" or "step for" are recited.

The invention claimed is:

1. An obscurant device comprising:

an obscurant payload comprising a plurality of powder particles provided in a packed powder configuration having a packing density of at least about 40%.

2. The obscurant device of claim 1, wherein the plurality of powder particles have been pressed radially using a pulsed dynamic pressing process to provide the packed powder configuration having the packing density of at least about 40%.

3. The obscurant device of claim 2, wherein the plurality of powder particles have been pressed radially using pulsed pressure by dynamic magnetic compaction to provide the packed powder configuration having the packing density of at least about 40%.

4. The obscurant device of claim 1, wherein the packed powder configuration comprises two or more packed powder layers.

5. The obscurant device of claim 4, wherein the two or more packed powder layers are separated by an intermittent paper fiber layer.

6. The obscurant device of claim 1, wherein the packed powder configuration comprises a first packed powder layer separated from a second packed powder layer by an intermittent paper fiber layer, and wherein the first packed powder layer comprises a different powder material than the second packed powder layer.

7. The obscurant device of claim 6, wherein the plurality of powder particles comprising the first packed powder layer have been pressed radially using a pulsed dynamic pressing process to provide the packed powder configuration having the packing density of at least about 40%.

8. The obscurant device of claim 7, wherein the plurality of powder particles comprising the second packed powder layer have been pressed radially using a pulsed dynamic pressing process to provide the packed powder configuration having the packing density of at least about 40%.

9. The obscurant device of claim 1, wherein the packed powder configuration comprises a plurality of packed powder layers, wherein adjacent packed powder layers are separated by an intermittent paper fiber layer.

10. The obscurant device of claim 9, wherein the plurality of packed powder layers are packed to have a concentric configuration.

11. The obscurant device of claim 9, wherein at least two packed powder layers comprise different powder materials.

12. The obscurant device of claim 9, wherein the plurality of packed powder layers are capable of providing screening in two or more electromagnetic spectrum regions chosen from the visible spectrum (approximately 0.38 um to approximately 0.78 um), the near infrared spectrum (NIR) (approximately 0.78 um to approximately 3 pm), the mid infrared spectrum (MIR) (approximately 3 um to approximately 50 um), and the far infrared spectrum (FIR) (approximately 50 um to approximately 1000 um).

13. The obscurant device of claim 1, wherein packing density of the plurality of powder particles provided in the packed powder configuration is least about 40% and up to about 80%.

14. The obscurant device of claim 1, wherein the obscurant device is a grenade.

15. The obscurant device of claim 1, wherein the obscurant device is capable of detonating to form an obscuration cloud that is at least 15% greater in size than an obscurant cloud of a comparable obscurant grenade prepared by press filing with the same plurality of powder particles to a packing density of up to 35%.

16. The obscurant device of claim 1, wherein the plurality of powder particles is in the form of spheres, disks, rods, flakes and combinations thereof.

17. A method of packing powder material within an obscurant device to provide an obscurant payload within a cavity of the obscurant device, the method comprising:

filling a first plurality of powder particles into the cavity; and radially pressing the first plurality of powder particles within the cavity using a pulsed dynamic pressing process to form a first packed powder layer having a packing density of at least about 40%.

18. The method of claim 17, further comprising:

providing a paper fiber layer within the cavity proximate the first packed powder layer;

filling a second plurality of powder particles into the cavity; and radially pressing the second plurality of powder particles within the cavity using a pulsed dynamic pressing process to form a second packed powder layer;

wherein the first and second packed powder layers have a packing density of at least about 40%.

19. A method of forming an obscurant payload within a cavity of an obscurant device, wherein the obscurant payload comprises at least three concentrically packed powder layers, the method comprising:

providing a central mandrel within the cavity of the obscurant device;

filling a first plurality of powder particles around the central mandrel within the cavity;

radially pressing the first plurality of powder particles within the cavity towards a wall of the obscurant device using a pulsed dynamic pressing process to form a first packed powder layer;

providing a first paper fiber layer within the cavity proximate the first packed powder layer;

filling a second plurality of powder particles between the first paper fiber layer and the central mandrel within the cavity;

radially pressing the second plurality of powder particles within the cavity towards the first paper fiber layer using the pulsed dynamic pressing process to form a second packed powder layer;

providing a second paper fiber layer within the cavity proximate the second packed powder layer;

filling a third plurality of powder particles between the second paper fiber layer and the central mandrel within the cavity; and radially pressing the third plurality of powder particles within the cavity towards the second paper fiber layer using the pulsed dynamic pressing process to form a third packed powder layer;

wherein the first, second and third packed powder layers have a packing density of at least about 40%.

20. The method of claim 18 wherein the first plurality of powder particles is a different powder material than at least one of the second and third plurality of powder particles.

21. The method of claim 18, wherein at least one of the first, second and third plurality of powders particles are dry particles in the form of spheres, disks, rods, flakes and combinations thereof.

* * * * *